US008154219B2

(12) United States Patent
Lin et al.

(10) Patent No.: US 8,154,219 B2
(45) Date of Patent: Apr. 10, 2012

(54) METHOD OF SCANNING BACKLIGHT DRIVING LAMPS FOR AN LCD

(75) Inventors: Chi-Hsiu Lin, Yun-Lin Hsien (TW); Chun-Chien Chiu, Taoyuan County (TW); Chien-Yang Chen, Taipei (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 435 days.

(21) Appl. No.: 12/490,348

(22) Filed: Jun. 24, 2009

(65) Prior Publication Data

US 2010/0123416 A1 May 20, 2010

(30) Foreign Application Priority Data

Nov. 20, 2008 (TW) ..... 97144869 U

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. .... 315/302; 315/291; 315/307; 315/DIG. 5

(58) Field of Classification Search ..... None
See application file for complete search history.

(56) References Cited

U.S. PATENT DOCUMENTS

| | | | | |
|---|---|---|---|---|
| 2004/0150355 | A1 * | 8/2004 | Tani et al. | 315/247 |
| 2006/0006811 | A1 * | 1/2006 | Green et al. | 315/209 R |
| 2011/0181197 | A1 * | 7/2011 | Kanda et al. | 315/268 |

* cited by examiner

*Primary Examiner* — Anh Tran
(74) *Attorney, Agent, or Firm* — Winston Hsu; Scott Margo

(57) ABSTRACT

A control signal is provided for turning on and turning off a lamp of a backlight source. For a first duration when the liquid crystal is rotating, adjust a frequency of the control signal to turn on and turn off the lamp of the backlight source consecutively or adjust a duty cycle of the control signal to turn off and then turn on the lamp of the backlight source. Thus, the backlight source has a luminance value for the first duration, and the control signal turns on the lamp of the backlight source for a second duration when the liquid crystal is in the steady state.

6 Claims, 4 Drawing Sheets

METHOD OF SCANNING BACKLIGHT DRIVING LAMPS FOR AN LCD

BACKGROUND OF THE INVENTION

1. Field of the Invention

The present invention is related to a method of scanning backlight module driving lamps for an LCD, and more particularly, to a method of scanning backlight module driving lamps for an LCD by adjusting the frequency and duty cycle of the control signal.

2. Description of the Prior Art

Due to luminance of a conventional backlight module of an LCD being fixed and unvaried with time, the conventional backlight module of an LCD is prone to a "motion blur" phenomenon and the quality of the display image is thereby degraded. A scanning backlight module and related method are then derived to solve this problem. Please refer to FIG. 1. FIG. 1 is a diagram illustrating a conventional scanning backlight module of a LCD. As shown in FIG. 1, an LCD panel 110 comprises three scanning sections 112, 114 and 116 and each scanning section corresponds to its own lamps 120 as the backlight source. The method for driving a conventional scanning backlight module of an LCD is described as below: in a first driving instance, the lamps 120*a* and 120*b* corresponding to the scanning section 112 are turned on, while the rest of the lamps are turned off; in the second driving instance, the lamps 120*c* and 120*d* corresponding to the scanning section 114 are turned on, while the rest of the lamps are turned off; in the third driving instance, the lamps 120*e* and 120*f* corresponding to the scanning section 116 are turned on, while the rest of the lamps are turned off; the above operation sequences are then repeated. For each scanning section, the display mechanism described above during a frame time is equivalent to inserting a blank frame and the motion blur issue can then be improved accordingly.

Please refer to FIG. 2. FIG. 2 is a diagram illustrating the signal waveforms of a conventional scanning backlight module of an LCD. As shown in FIG. 2, the signal S1 represents the control signal of the backlight module, the period D represents the duty cycle of the signal S1, the frequency F represents the frequency of the signal S1, the signal IL represents the operating current of the lamp, the signal LS represents the luminance of the lamp, the duration Tr represents the luminance raising time, and the duration Tf represents the luminance falling time. The on/off operation of the backlight module is controlled by the signal S1 and the ratio of the backlight module being turned on/off is determined by the duty cycle D. When the backlight module is turned on by the signal S1, the lamp requires the duration Tr to reach stable luminance, and when the backlight module is turned off by the signal S1, the lamp is darkened after the duration Tf. Due to the relatively long luminance raising/falling time required by the lamp, the effectiveness of using the black frame insertion method to improve the motion blur issue is limited.

As mentioned above, the driving method of the scanning backlight module of an LCD does not require all of the lamps 120 to be turned on simultaneously, therefore the overall luminance of the LCD is lower than that of the LCD with the conventional backlight module. For example, as shown in FIG. 1, the overall luminance and power consumption of the LCD with a scanning backlight module are approximately one third of the overall luminance and power consumption of the LCD with the conventional backlight module.

For improving the degraded overall luminance of the LCD with the scanning backlight module, a solution is to increase the luminance of the lamps 120. Increasing the luminance of the lamps 120, however, means the lamps 120 must be driven with a higher electric condition (a greater lamp current for example), and consequently decreasing the lifetime of the lamps.

SUMMARY OF THE INVENTION

It is therefore an objective of the present invention to provide a method of scanning backlight module of an LCD driving lamps for an LCD.

The present invention provides a method of a scanning backlight module of an LCD driving lamps. The method comprises providing a control signal for turning on and turning off the lamps of a backlight source; adjusting frequency of the control signal for consecutively turning on and turning off the lamps of the backlight source in a first duration; and turning on the lamps of the backlight source in a second duration.

The present invention further provides a method of a scanning backlight module of an LCD driving lamps. The method comprises providing a control signal for turning on and turning off the lamps of a backlight source; adjusting a duty cycle of the control signal for turning off then turning on the lamps of the backlight source in a first duration; and turning on the lamps of the backlight source in a second duration.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . " Also, the term "electrically connect" is intended to mean either an indirect or direct electrical connection. Accordingly, if one device is coupled to another device, that connection may be through a direct electrical connection, or through an indirect electrical connection via other devices and connections.

In general, the fluorescent lamps of the backlight module of a LCD comprise hot cathode fluorescent lamps (HCFL) and cold cathode fluorescent lamps (CCFL). Taking the CCFL as an example, to decrease from 90% to 30% of the relative luminance approximately requires 3 ms; to increase from 10% to 90% of the relative luminance approximately requires 3 ms; to decrease from 100% to 0% of the relative luminance approximately requires 10 ms; and to increase from 0% to 100% of the relative luminance approximately requires 10 ms. The CCFL requires a relatively longer luminance raising/falling time (i.e. slow luminance response), so the effect of improving motion blur is limited when the CCFL is utilized in the black frame insertion technology of the scanning backlight module. By making use of the property of the slow luminance response time of the lamps of the backlight source, the present invention turns on the lamps of the backlight source again while the luminance of the lamps of the backlight source is not fully diminished, and on the contrary, the present invention turns off the lamps of the backlight source again while the lamps of the backlight source is still raising for full luminance. Therefore, the backlight module can maintain a certain level of luminance during black frame insertion, for improving the issues of luminance insufficiency and flicker of the black frame insertion method.

Figure 1:
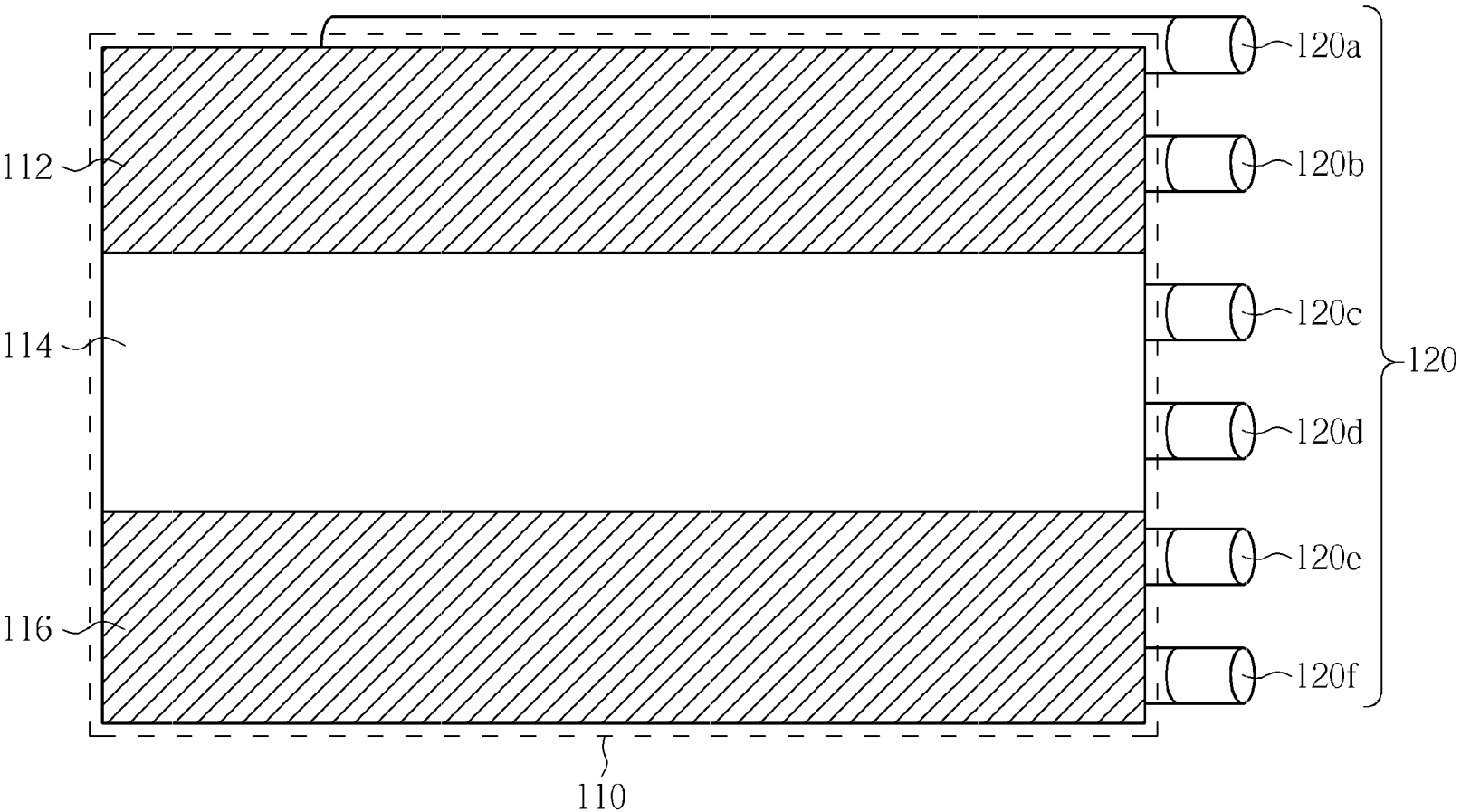
FIG. 1 PRIOR ART
FIG. 1 is a diagram illustrating a conventional scanning backlight module of a LCD.
Figure 2:
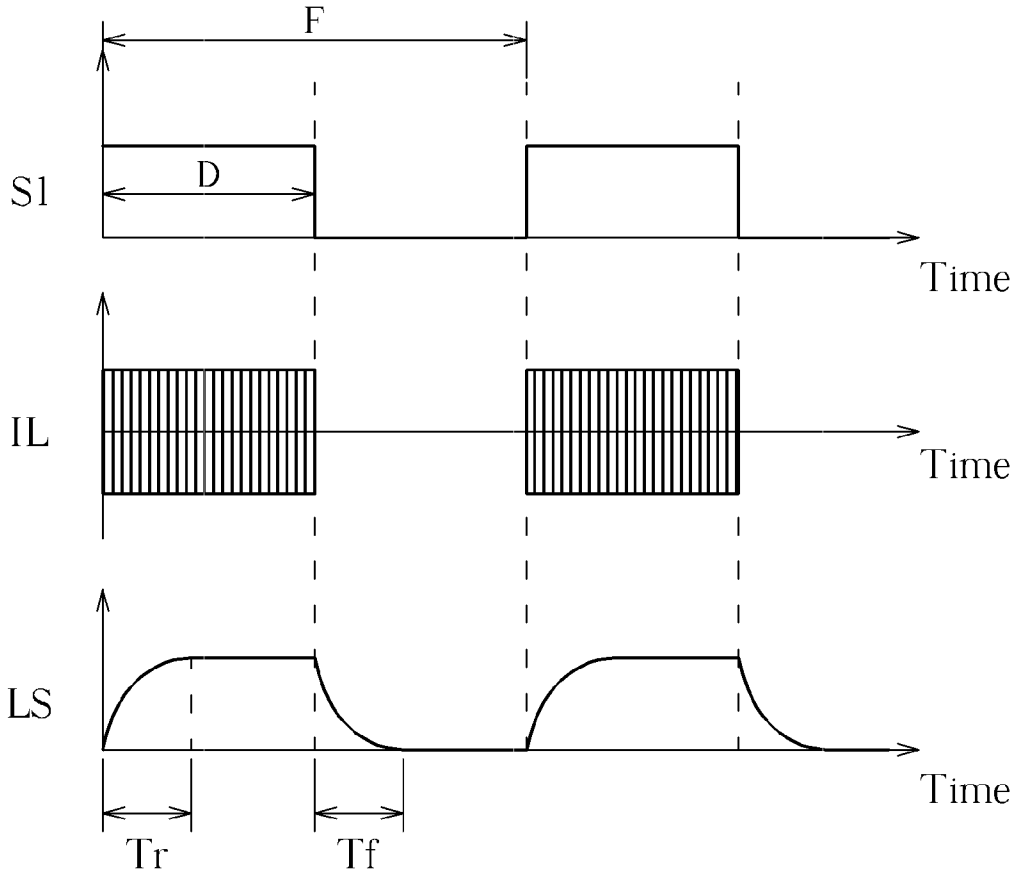
FIG. 2 PRIOR ART
FIG. 2 is a diagram illustrating the signal waveforms of a conventional scanning backlight module of an LCD.
Figure 3:
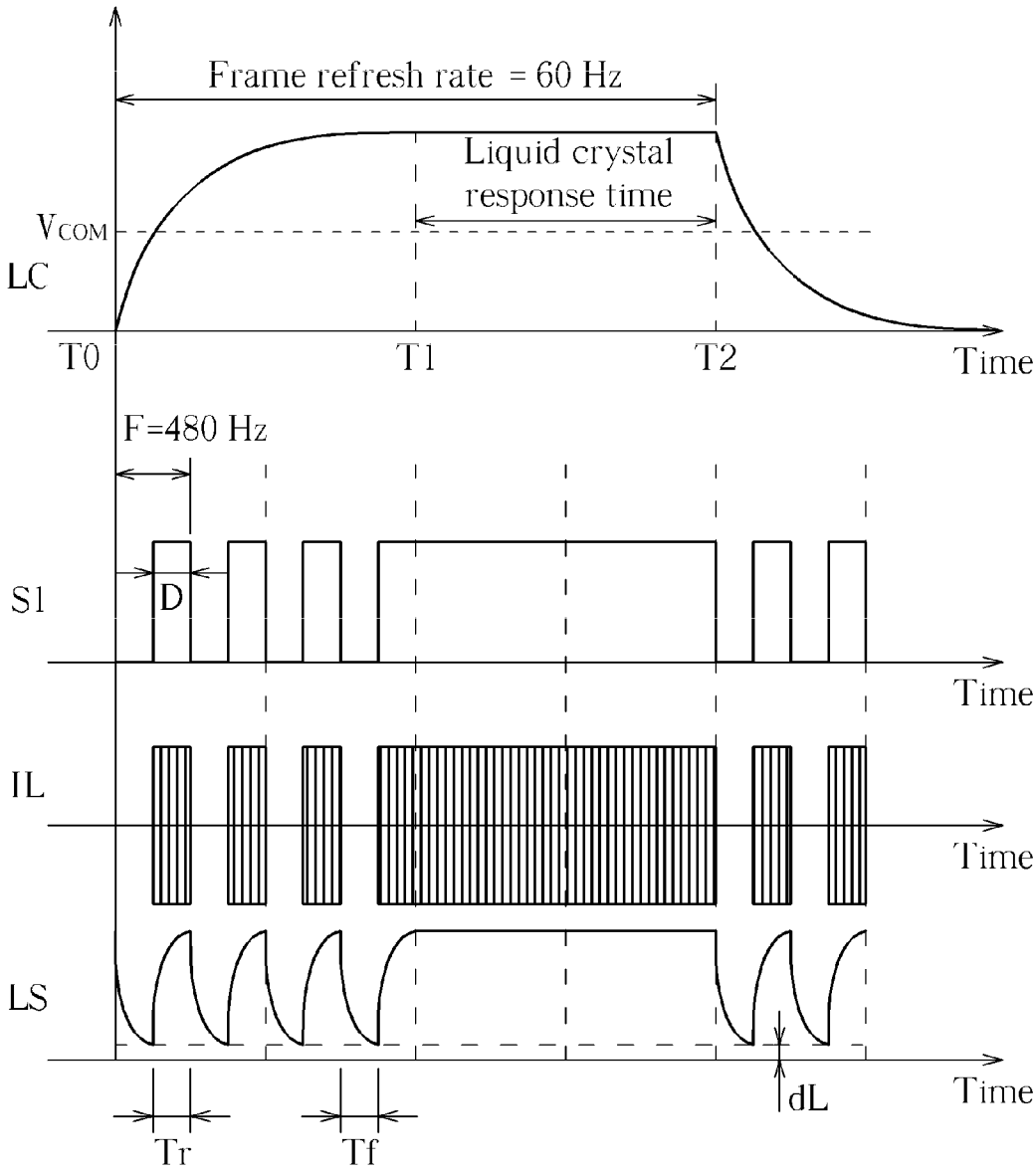
FIG. 3 is a waveform diagram of the first embodiment of the method of scanning backlight module driving lamps of an LCD according to the present invention.

Please refer to FIG. 3. FIG. 3 is a waveform diagram of the first embodiment of the method of scanning backlight module driving lamps of an LCD according to the present invention. As shown in FIG. 3, the signal LC represents the response voltage of the liquid crystal of the LCD, the signal S1 represents the control signal of the backlight module, the signal IL represents the operating current of the lamps, and the signal LS represents the luminance of the lamps. In the duration of T0~T1, the liquid crystal is in the charging status, indicating the presence of the motion blur because the liquid crystal is rotating. Therefore, by turning off the backlight during T0~T1, the liquid crystal rotation is less visible and the motion blur is thereby improved. However, when the backlight module is completely turned off during T0~T1, the display image may experience issues of low luminance and flicker. In addition, if the backlight module is turned on at time T1 then the luminance of the lamps may not be able to reach a stable level immediately, due to the relatively slow luminance response time of the lamps of the backlight source. Therefore in the present embodiment, the frequency of the control signal S1 in the duration of T0~T1 is adjusted to turn on the backlight module again before the luminance is completely diminished, so that the backlight source can maintain a certain level of luminance. Therefore the issue of insufficient luminance of the black frame insertion method can be solved.

As shown in FIG. 3, the duration Tr represents the luminance raising time and the duration Tf represents the luminance falling time. When the signal S1 changes quickly, due to the slow luminance response of the lamps of the backlight source, the luminance signal LS of the lamps still has a luminance value dL. The luminance value dL is directly proportional to the frequency of the signal S1. The luminance value dL also fulfills the following frequency relation formula:

$$(1-D)*T_{cycle}<Tf \quad (1)$$

wherein D represents the duty cycle of the signal S1, $T_{cycle}$ represents the reciprocal of the frequency F of the signal s1, Tf represents the luminance falling time of the lamps of the backlight module. In the present embodiment, the selected duty cycle of the signal S1 is 0.5. For the luminance signal LS to have a minimum luminance value dL, $T_{cycle}$ needs to be lower than 6 ms according to formula (1), and indicating the frequency F of the signal S1 is larger than 167 Hz. Generally, the refresh frequency of a frame is 60 Hz and the frequency of the signal S1 of the present embodiment is 480 Hz. In the duration of T0~T1, the backlight module is turned on and off according to the signal S1, which is equivalent to a clock signal with the duty cycle of 0.5 and the frequency of 480 Hz. In the duration of T1~T2, the signal S1 keeps the backlight module to be turned on until the end of the frame.

According to the present embodiment, when the rotation of the liquid crystal has not reached the steady state, the control signal of the backlight module is adjusted so that the backlight can have a luminance value dL for improving the issues of insufficient luminance and flicker of the black frame insertion technology. Also, as stated in formula (1), the luminance value dL is directly proportional to the frequency F of the signal S1 in the duration of T0~T1.

Figure 4:
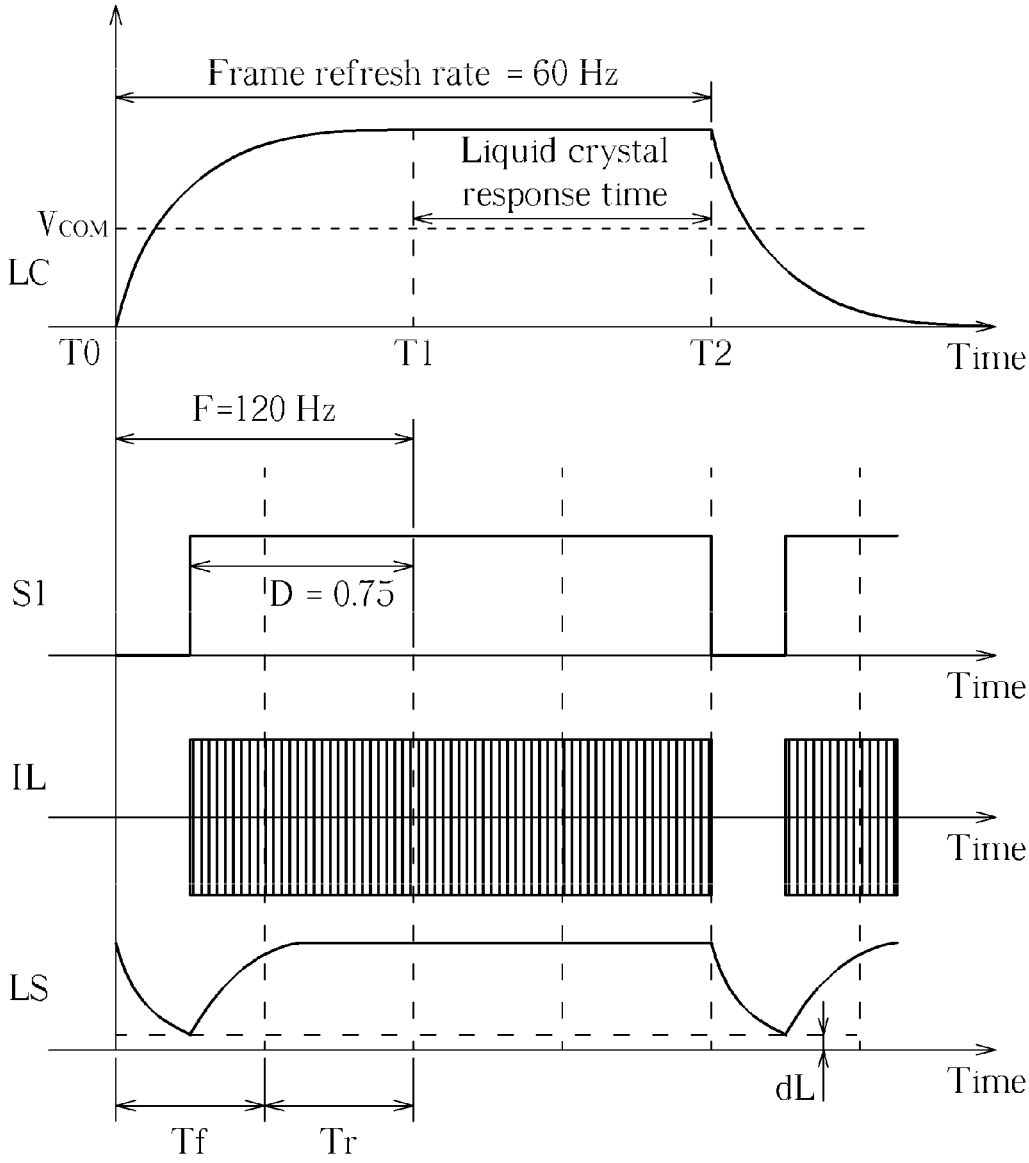
FIG. 4 is a waveform diagram illustrating the second embodiment of the method of scanning backlight module driving lamps of an LCD according to the present invention.

Please refer to FIG. 4. FIG. 4 is a waveform diagram illustrating the second embodiment of the method of scanning backlight module driving lamps of an LCD according to the present invention. In FIG. 4, the signal LC represents the response voltage of the liquid crystal, the signal S1 represents the control signal of the backlight module, the signal IL represents the operating current of the lamps and the signal LS represents the luminance of the lamps. Due to the relatively slow luminance response time of the lamps of the backlight source, if the backlight module is turned on at time T1 then the luminance of the lamps may not be able to reach a stable level immediately. In the present embodiment, the duty cycle of the control signal S1 during T0~T1 is adjusted to turn on the backlight module again before the luminance is completely diminished. Therefore the backlight module can still have a certain level of luminance, which solves the issue of insufficient luminance of the black frame insertion technology.

As shown in FIG. 4, Tr represents the luminance raising time and Tf represents the luminance falling time. Before the luminance of the lamp is completely diminished, the backlight module is turned on again. Therefore the luminance signal LS of the lamps still has a luminance value dL. The duty cycle of the signal S1 is directly proportional to the luminance value dL, i.e. the higher the duty cycle of the signal S1, the higher the luminance value dL. In the present embodiment, the frequency of the signal S1 is 120 Hz. For the luminance signal LS to have a minimum luminance value dL, the duty cycle needs to be larger than 0.64, according to the formula (1). Generally, the refresh frequency of a frame is 60 Hz and the duty cycle of the signal S1 of the present embodiment is selected to be 0.75. In the duration of T0~T1, the signal S1 turns on the backlight module in advance. In the duration of T1~T2, the signal S1 keeps the backlight module to be turned on until the end of the frame. According to the present embodiment, the duty cycle of the control signal is controlled so that the backlight module can still have a luminance value dL when the liquid crystal has not rotated to the steady state, improving the issues of insufficient luminance and the flicker of the black frame insertion technology. Also, according to the formula (1), the magnitude of the luminance value dL is directly proportional to the signal S1.

In conclusion, the method of scanning backlight module driving lamps for an LCD according to the present invention provides a control signal for turning on and turning off a lamp of a backlight source. For a first duration when the liquid crystal is rotating, a frequency of the control signal is adjusted to turn on and turn off the lamp of the backlight source consecutively, or a duty cycle of the control signal is adjusted to turn off and then turn on the lamp of the backlight source. Thus, the backlight source has a luminance value for the first duration, and the control signal turns on the lamp of the backlight source for a second duration when the liquid crystal is stable.

The scanning backlight module can effectively improve the issue of motion blur of the LCD. The present invention utilizes the frequency and the duty cycle of the control signal to adjust the backlight module, so that the backlight module can still have a luminance value during the period of the black frame insertion. Therefore the issue of insufficient luminance of the scanning backlight module is improved. Also, due to the luminance difference between the lamps of the backlight module is lowered; the issue of flicker is also improved.

Those skilled in the art will readily observe that numerous modifications and alterations of the device and method may be made while retaining the teachings of the invention.

What is claimed is:

1. A method of a scanning backlight module of an LCD driving lamps, the method comprising:

providing a control signal for turning on and turning off the lamps of a backlight source;

adjusting frequency of the control signal for consecutively turning on and turning off the lamps of the backlight source to cause the backlight source to generate a luminance value when driving liquid crystals of the LCD to rotate; and turning on the lamps of the backlight source when the liquid crystals of the LCD is in a steady state.

2. The method of claim 1, wherein adjusting the frequency of the control signal for consecutively turning on and turning off the lamps of the backlight source to cause the backlight source to generate a luminance value when driving liquid crystals of the LCD to rotate comprises:

adjusting the frequency of the control signal so that a period for turning off the backlight source can be less than a luminance falling time of the lamps of the backlight source.

3. The method of claim 1, wherein adjusting the frequency of the control signal for consecutively turning on and turning off the lamps of the backlight source to cause the backlight source to generate a luminance value when driving liquid crystals of the LCD to rotate comprises:

adjusting the control signal to have an identical duty cycle when rotating the liquid crystals of the LCD.

4. A method of a scanning backlight module of an LCD driving lamps, the method comprising:

providing a control signal for turning on and turning off the lamps of a backlight source;

adjusting a duty cycle of the control signal for turning off then turning on the lamps of the backlight source to cause the backlight source to generate a luminance value when driving liquid crystals of the LCD to rotate; and turning on the lamps of the backlight source when the liquid crystals of the LCD is in a steady state.

5. The method of claim 4, wherein adjusting the duty cycle of the control signal for turning off then turning on the lamps of the backlight source to cause the backlight source to generate a luminance value when driving liquid crystals of the LCD to rotate comprises:

adjusting the duty cycle of the control signal so that a period for turning off the backlight source can be less than a luminance falling time of the lamps of the backlight source.

6. The method of claim 4, wherein adjusting the duty cycle of the control signal for turning off then turning on the lamps of the backlight source to cause the backlight source to generate a luminance value when driving liquid crystals of the LCD to rotate comprises:

adjusting the control signal to have an identical frequency when rotating the liquid crystals of the LCD.

* * * * *